US008624144B2

(12) United States Patent
Chiang

(10) Patent No.: US 8,624,144 B2
(45) Date of Patent: Jan. 7, 2014

(54) PUSH BUTTON CAP MOUNTING DETAILS

(75) Inventor: Po-Ching Chiang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 139 days.

(21) Appl. No.: 13/400,193

(22) Filed: Feb. 20, 2012

(65) Prior Publication Data

US 2012/0318651 A1 Dec. 20, 2012

(30) Foreign Application Priority Data

Jun. 14, 2011 (TW) ..... 100120783 A

(51) Int. Cl.
*H01H 13/70* (2006.01)

(52) U.S. Cl.
USPC ..... 200/345

(58) Field of Classification Search
USPC ..... 200/5 A, 341, 345, 344
IPC ..... G06F 3/0202; H01H 3/12,3/125
See application file for complete search history.

(56) References Cited

U.S. PATENT DOCUMENTS

| | | | | |
|---|---|---|---|---|
| 5,380,970 | A * | 1/1995 | Mizuno et al. | 200/523 |
| 5,399,824 | A * | 3/1995 | Chen | 200/534 |
| 5,938,009 | A * | 8/1999 | Huang | 200/517 |
| 6,242,705 | B1 * | 6/2001 | Huang | 200/520 |
| 7,649,151 | B2 * | 1/2010 | Li | 200/344 |
| 7,964,813 | B2 * | 6/2011 | Ting et al. | 200/344 |

* cited by examiner

*Primary Examiner* — Vanessa Girardi
(74) *Attorney, Agent, or Firm* — Altis Law Group, Inc.

(57) ABSTRACT

A button or key structure includes a cap, a base and a connecting member. The cap includes at least two stopper portions. The base includes at least two hooks. The connecting member includes a resilient part. The connecting member is engaged between the at least two hooks and located between the cap and the base. The resilient part is configured for driving the cap away from the base. Each of the at least two hooks is engaged with each of the at least two stopper portions to prevent the cap from disengaging from the base.

20 Claims, 7 Drawing Sheets

PUSH BUTTON CAP MOUNTING DETAILS

BACKGROUND

1. Technical Field

The present disclosure relates to push buttons, and particularly to a push button for a computer keyboard.

2. Description of Related Art

A push button on a computer keyboard may have at least the following five components including a cap, a base, a circuit board and at least two connecting member. The push button with such a structure is complex and the manufacturing cost may be high.

Therefore, there is room for improvement within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
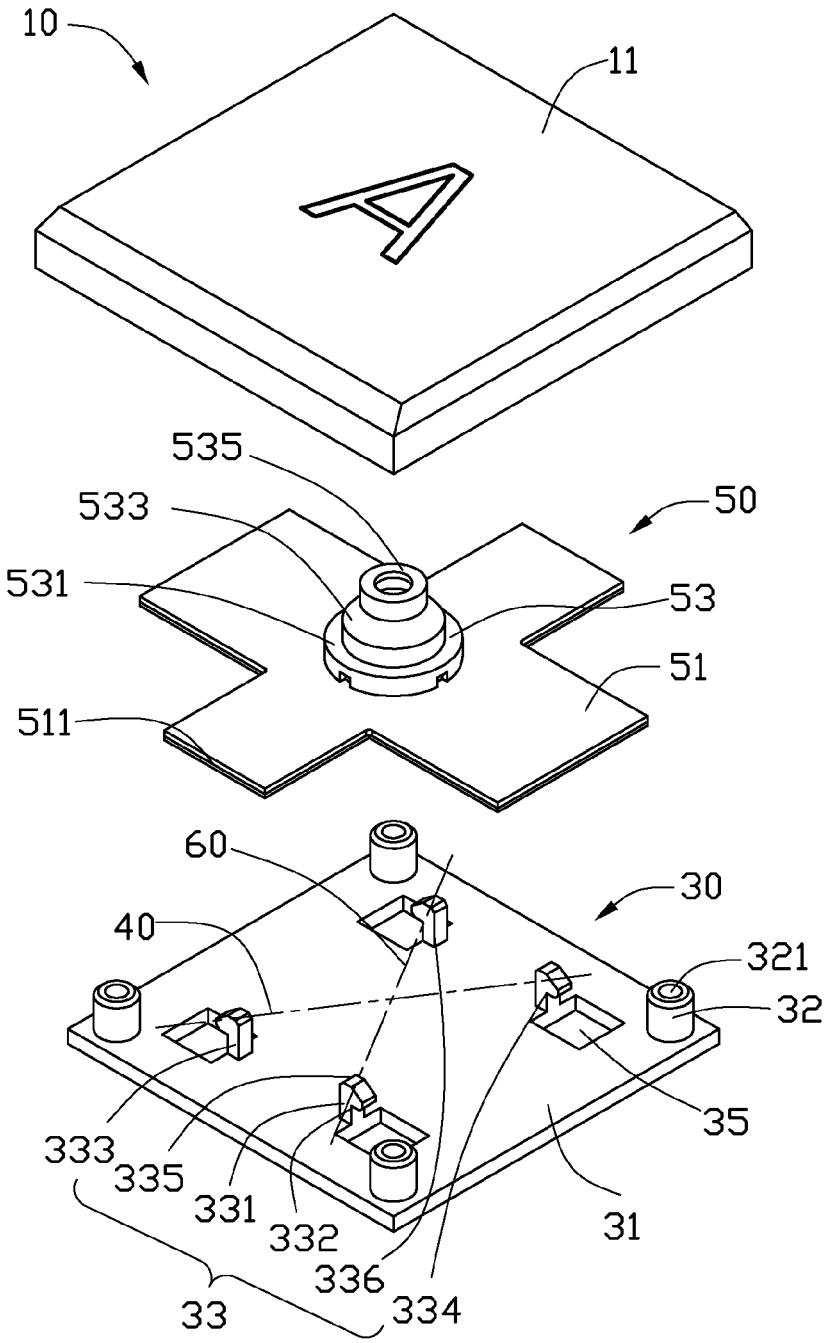
FIG. 1 is an exploded, isometric view of an embodiment of a push button.
Figure 2:
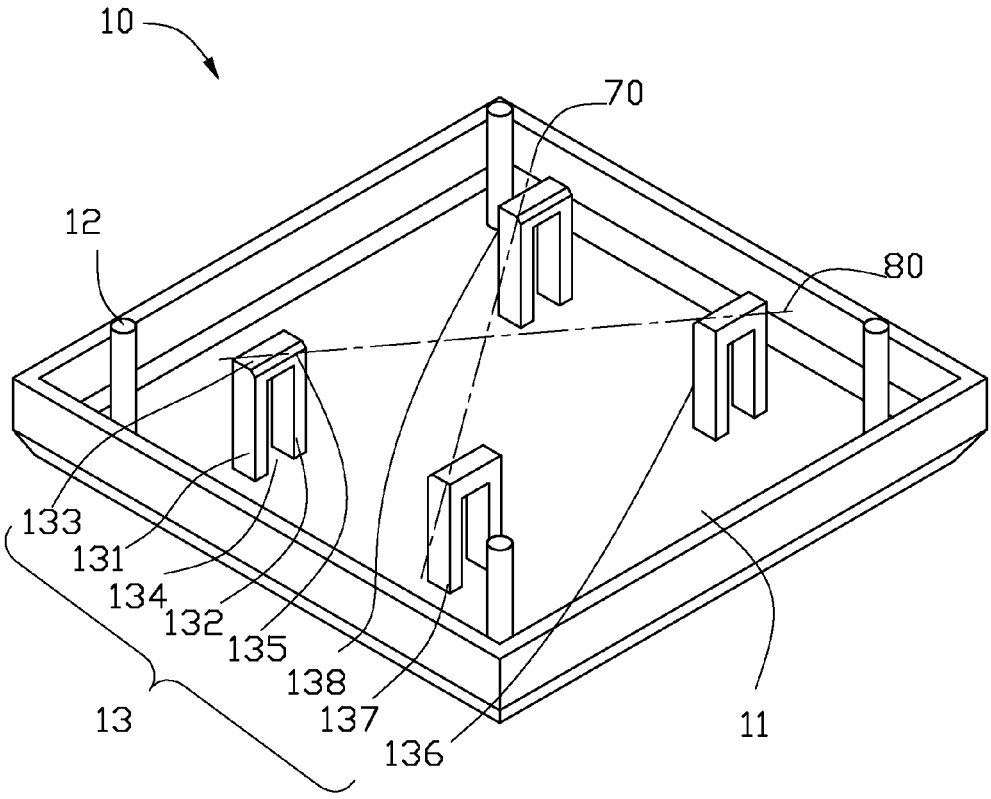
FIG. 2 is an isometric view of a cap of the push button of FIG. 1.
Figure 3:
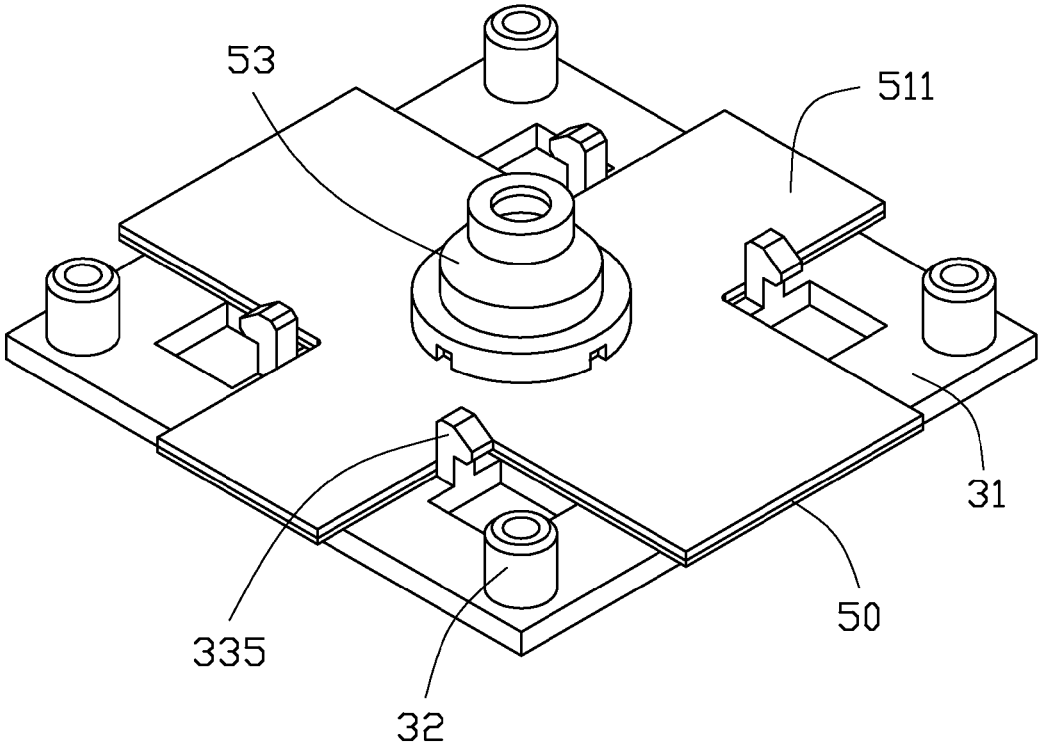
FIG. 3 is an assembled view of a base and a connecting member of the push button of FIG. 1.
Figure 4:
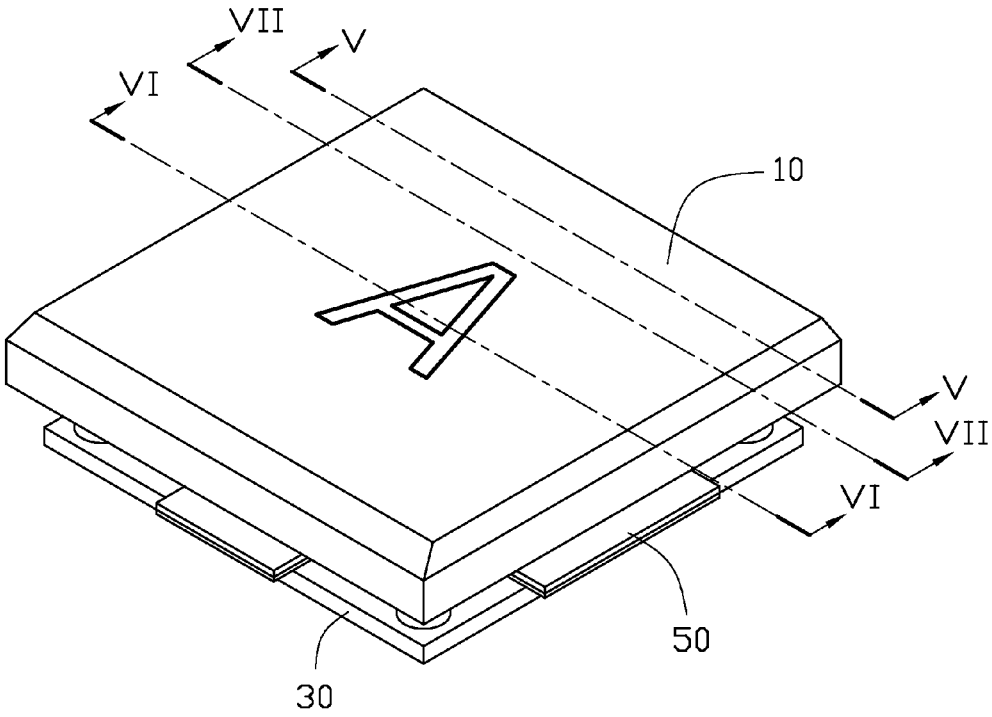
FIG. 4 is an assembled view of the push button of FIG. 1.
Figure 5:
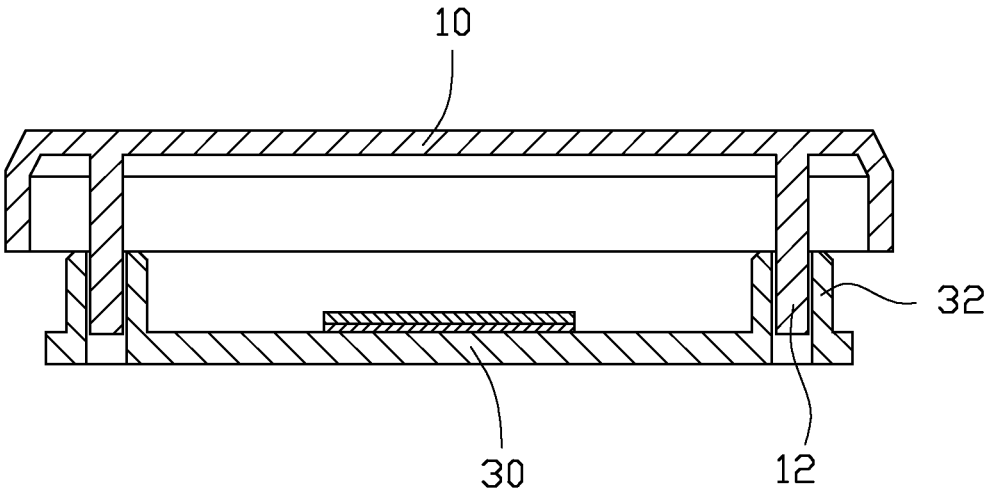
FIG. 5 is a cross-sectional view of the push button of FIG. 4, taken along the line V-V.
Figure 6:
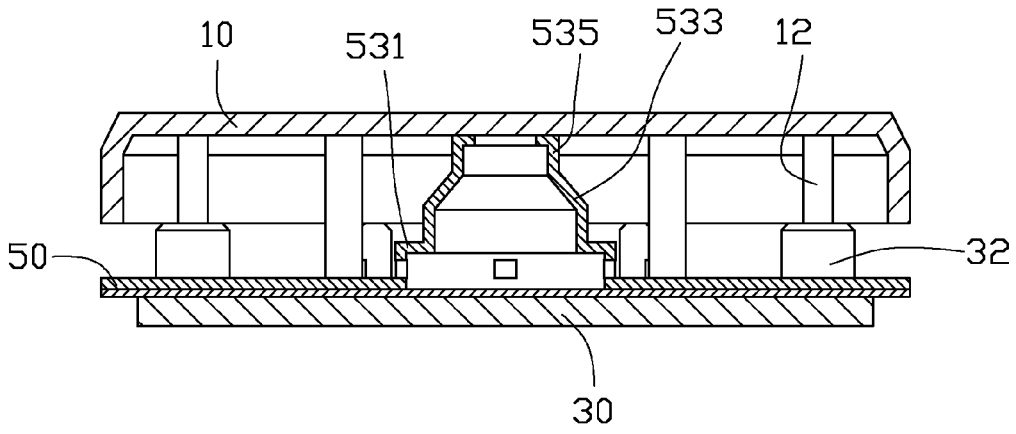
FIG. 6 is a cross-sectional view of the push button of FIG. 4, taken along the line VI-VI.
Figure 7:
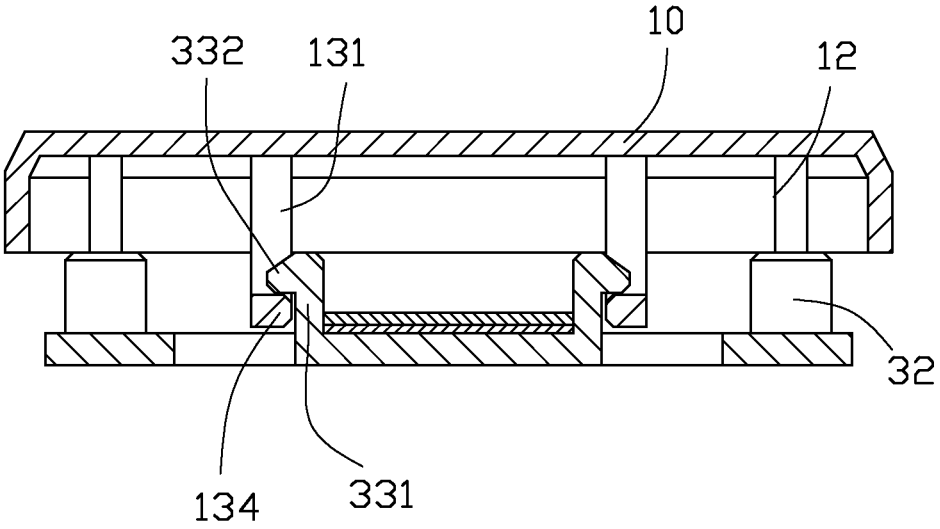
FIG. 7 is a cross-sectional view of the push button of FIG. 4, taken along the line VII-VII.

Referring to FIG. 1, a push button or key in accordance with an embodiment comprises a cap 10, a base 30 and a connecting member 50.

Referring to FIG. 1, the cap 10 comprises a cover 11. In one embodiment, the cover 11 is substantially rectangular. Four posts 12 extend from the cover 11. In one embodiment, the four posts 12 are arranged at four corners of the cover 11; each of the four positioning portions 121 is substantially columnar and perpendicular to the cover 11. Four stopper portions 13 are located on the cover 11. The four stopper portions 13 and the four posts 12 are both on the underside of the cover 11. The four stopper portions 13 substantially have the same configuration. Each of the four stopper portions 13 comprises a first limiting portion 131 extending from the cover 11, a second limiting portion 132 extending from the cover 11, and a blocking portion 133 connecting the first limiting portion 131 and the second limiting portion 132. The first limiting portion 131, the second limiting portion 132 and the blocking portion 133 together define a receiving hole 134. In one embodiment, the first limiting portion 131 is substantially parallel to the second limiting portion 132, the first limiting portion 131 is substantially perpendicular to the cover 11, and the blocking portion 133 is substantially parallel with the cover 11. The stopper portions 13 comprise a first stopper portion 135, a second stopper portion 136, a third stopper portion 137 and a fourth stopper portion 138. In one embodiment, a first line 80 connecting the first stopper portion 135 and the second stopper portion 136 is substantially perpendicular to a second line 70 connecting the third stopper portion 137 and the fourth stopper portion 138.

Referring to FIG. 1, the base 30 includes a supporting board 31. In one embodiment, the supporting board 31 is substantially rectangular. Four installation portions 32 are located on the supporting board 31. In one embodiment, the four installation portions 32 are arranged at four corner of the supporting board 31. Each of the four installation portions 32 defines an installation hole 321. In one embodiment, each of the four installation portions 32 is substantially perpendicular to the supporting board 31. Four hooks 33 are located on the supporting board 31. The four hooks 33 have the same configurations. Each of the four hooks 33 comprises a positioning portion 331 extending from the supporting board 31, and a latching portion 332 extending from the positioning portion 331. In one embodiment, the positioning portion 331 is substantially perpendicular to the supporting board 31, and the positioning portion 331 is substantially perpendicular to the latching portion 332. The four hooks 33 comprise a first hook 333, a second hook 334, a third hook 335 and a fourth hook 336. An extension direction of the latching portion 332 of the first hook 333 is opposite to an extension direction of the latching portion 332 of the second hook 334. An extension direction of the latching portion 332 of the third hook 335 is opposite to an extension direction of the latching portion 332 of the fourth hook 336. In one embodiment, a third line 40 connecting the first hook 333 and the second hook 334 is substantially perpendicular to a fourth line 60 connecting the third hook 335 and the fourth hook 336. Four openings 35 are defined in the supporting board 31. The connecting portion 331 of each of the four hooks 33 extends from an edge of each of the four openings 35.

Referring to FIG. 1, the connecting member 50 comprises a circuit board 51 and a resilient part 53 located on the circuit board 51. The resilient part 53 comprises a supporting portion 531, a connecting portion 533 extending from the supporting portion 531, and an abutting portion 535 extending from the connecting portion 533. In one embodiment, a cross-sectional area of the supporting portion 531 is greater than that of the connecting portion 533 and the abutting portion 535, and a cross-sectional area of the connecting portion 533 is greater than that of the abutting portion 535. Four extending portions 511 extend from the circuit board 51. In one embodiment, the circuit board 51 resembles a cross.

Referring to FIGS. 3-7, in assembly, the connecting member 50 is placed on the base 30, and each of the four extending portions 511 is engaged between adjacent two of the four hooks 33 to prevent the connecting member 50 from moving relative to the base 30. The cover 11 of the cap 10 is aligned with the base 30, and each of the four posts 12 is engaged into the installation hole 321 of each of the four installation portions 32. The latching portion 332 of each of the four hooks 33 is engaged into the receiving hole 134 to keep the cap 10 captive on the base 30. The cover 11 abuts the resilient part 53.

In use, the cover 11 of the cap 10 is pressed to elastically deform the resilient part 53, and the resilient part 53 is moved towards the supporting board 31 until the cap 10 makes contact with the circuit board 51. The circuit board 51 can send a signal, and the cap 10 is in a first position. When the cover 11 is released, the resilient part 53 repulses the cap 10 to an original position.

Although numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A push button comprising:

a cap, the cap comprising a cover, at least two stopper portions located on the cover;

a base, the base comprising a supporting board, at least two hooks located on the supporting board;

a planar connecting member comprising a circuit board on which is mounted a resilient part;

wherein the connecting member is located between the cover and the supporting board, the resilient part is configured to move the cap away from the base, and each of the at least two hooks is engaged with each of the at least two stopper portions to prevent the cap from disengaging from the base;

the at least two hooks comprise a first hook, a second hook, a third hook and a fourth hook; and a third line connecting the first hook and the second hook is substantially perpendicular to a fourth line connecting the third hook and the fourth hook.

2. The push button of claim 1, wherein four installation portions are arranged at four corners of the supporting board, and each of the four installation portions defines a installation hole, four posts are arranged at four corners of the cover, and each of the four posts is engaged in the installation hole of each of the four installation portions.

3. The push button of claim 2, wherein each of the four posts is substantially perpendicular to the cover.

4. The push button of claim 1, wherein the connecting member further comprises a circuit board, the circuit board comprises four extending portions, and each of the four extending portions is engaged with adjacent two of the first hook, the second hook, the third hook, and the fourth hook.

5. The push button of claim 4, wherein the resilient part comprises a supporting portion extending from the circuit board, a connecting portion extending from the supporting portion, and an abutting portion extending from the connecting portion; a cross-sectional area of the supporting portion is larger than a cross-sectional area of the connecting portion; and the cross-sectional area of the connecting portion is larger than a cross-sectional area of the abutting portion.

6. The push button of claim 1, wherein the at least two hooks have same configurations, and each of the at least two hooks comprises a positioning portion extending from the supporting board and a latching portion extending from the positioning portion, and the latching portion is substantially perpendicular to the positioning portion.

7. The push button of claim 6, wherein the at least two stopper portions have same configurations, and each of the at least two stopper portions comprises a first limiting portion, a second limiting portion parallel to the first limiting portion, and a blocking portion connecting the first limiting portion and the second limiting portion; the first limiting portion, the second limiting portion and the blocking portion together define a receiving hole; and the latching portion is engaged in the receiving hole.

8. The push button of claim 7, wherein each of the at least two stopper portions comprise a first stopper piece, a second stopper piece, a third stopper piece and a fourth stopper portion, a first line connecting the first stopper portion and the second stopper portion, a second line connecting the third stopper portion and the fourth stopper portion, and the first line is substantially perpendicular to the second line.

9. The push button of claim 7, wherein at least two openings are defined in the supporting board, and each of the at least two hooks extends from an edge of each of the at least two openings.

10. A push button comprising:

a cap, the cap comprising a cover, four stopper portions and four posts located on the cover;

a base, the base comprising a supporting board, four hooks and four installation portions located on the supporting board;

a connecting member engaged between the four hooks, the connecting member comprising a resilient part;

wherein the connecting member is located between the cover and the supporting board, each of the four posts is slidably engaged in each of the four installation portions, the resilient part is configured to drive the cap to move relative to the base, and each of the four hooks engages with each of the four stopper portions to prevent the cap from disengaging from the base.

11. The push button of claim 10, wherein the four stopper portions comprise a first stopper piece, a second stopper piece, a third stopper piece and a fourth stopper portion; and a first line connecting the first stopper portion and the second stopper portion is substantially perpendicular to a second line connecting the third stopper portion and the fourth stopper portion.

12. The push button of claim 10, wherein four openings are defines on the supporting board, and each of the four hooks extends from each of the four openings.

13. The push button of claim 10, wherein each of the four posts is substantially perpendicular to the cover.

14. The push button of claim 10, wherein the connecting member further comprises a circuit board, the circuit board comprises four extending portions, each of the four extending portions is engaged with adjacent two of the four hooks.

15. The push button of claim 14, wherein the resilient part comprises a supporting portion extending from the circuit board, a connecting portion extending from the supporting portion, and a abutting portion extending from the connecting portion; a cross-sectional area of the supporting portion is larger than a cross-sectional area of the connecting portion; and the cross-sectional area of the connecting portion is larger than a cross-sectional area of the abutting portion.

16. The push button of claim 10, wherein each of the four hooks has the same configuration, and comprises a positioning portion extending from the supporting board, and a latching portion extending from the positioning portion; the latching portion is substantially perpendicular to the positioning portion.

17. The push button of claim 16, wherein the four hooks comprise a first hook, a second hook, a third hook and fourth hook; a third line connecting the first hook and the second hook is substantially perpendicular to a fourth line connecting the third hook and the fourth hook.

18. The push button of claim 16, wherein each of the fourth stopper portions has the same configuration, and comprises a first limiting portion extending from the cover, a second extending from the cover, and a blocking portion connecting the first limiting portion and the second limiting portion; the first limiting portion, the second limiting portion and the blocking portion together define a receiving hole; and the latching portion is engaged in the receiving hole.

19. The push button of claim 18, wherein the first limiting portion is substantially parallel with the second limiting portion, the first limiting portion is substantially perpendicular to the cover, and the blocking portion is substantially parallel with the cover.

20. A push button comprising:

a cap, the cap comprising a cover, at least two stopper portions located on the cover;

a base, the base comprising a supporting board, at least two hooks located on the supporting board;

a planar connecting member comprising a circuit board on which is mounted a resilient part;

wherein the connecting member is located between the cover and the supporting board, the resilient part is configured to move the cap away from the base, and each of the at least two hooks is engaged with each of the at least two stopper portions to prevent the cap from disengaging from the base;

the at least two hooks have same configuration, and each of the at least two hooks comprises a positioning portion extending from the supporting board and a latching portion extending from the positioning portion, and the latching portion is substantially perpendicular to the positioning portion; and the at least two stopper portions each define a receiving hole; and the respective latching portion is engaged in the respective receiving hole.

* * * * *